United States Patent [19]

Warren et al.

[11] Patent Number: 5,042,388

[45] Date of Patent: Aug. 27, 1991

[54] FORWARD CONTROL TUBE WITH SEQUENCED IGNITION

[75] Inventors: John B. Warren, Plymouth; David E. Broden, Minnetonka, both of Minn.

[73] Assignee: Alliant Techsystems Inc., Minnetonka, Minn.

[21] Appl. No.: 613,256

[22] Filed: Nov. 14, 1990

[51] Int. Cl.[5] ..... F42B 5/045

[52] U.S. Cl. ..... 102/434; 102/435; 102/443

[58] Field of Search ..... 102/433, 434, 435, 443

[56] References Cited

U.S. PATENT DOCUMENTS

| | | | |
|---|---|---|---|
| 390,232 | 10/1888 | Hurst | 102/443 |
| 4,335,657 | 6/1982 | Bains | 102/443 |
| 4,715,284 | 12/1987 | Hendry et al. | 102/434 |
| 4,846,069 | 7/1989 | Tasson et al. | 102/434 |
| 4,858,533 | 8/1989 | Warren | 102/434 |

FOREIGN PATENT DOCUMENTS

| | | | |
|---|---|---|---|
| 16841 | of 1888 | United Kingdom | 102/443 |

*Primary Examiner*—Harold J. Tudor
*Attorney, Agent, or Firm*—Whitham & Marhoefer

[57] ABSTRACT

A cased telescoped ammunition with a perforated forward control tube in which the main propellant gas and flame front ignites a propellant surrounding the tube through the perforations. Seals form annular segments of consolidated propellant surrounding the tube separated from each other and the main propellant charge. These seals prevent gas and flame front propagation from the main or rearmost charge of propellant, except through the control tube perforations or ports which have been passed by the obturator.

8 Claims, 3 Drawing Sheets

FORWARD CONTROL TUBE WITH SEQUENCED IGNITION

BACKGROUND OF THE INVENTION

Field of the Invention

The present invention generally relates to cased telescoped ammunition employing a forward control tube, and more particularly to an improved ammunition of this type which prevents premature pressure build-up in the control tube.

As will be appreciated by those skilled in the art, conventional prior art cased telescoped ammunition employs a rear control tube. New proposals have been made to use a forward control tube in a cased telescoped ammunition. While potentially advantageous, applicants' have identified certain problems in the use of a forward control tube for cased telescoped ammunition when used in conjunction with a saddle-type sabot as opposed to a puller-type sabot.

A forward control tube should be perforated to prevent a build-up of an excessive pressure differential across the tube when used in conjunction with a saddle-type sabot as opposed to a puller-type sabot. There is a limit to how thick a tube can be made and still be practically useful. Tubes with a thickness in the practical range would not survive without such perforations. A problem arises because gas from ignited propellant surrounding the control tube passes through these perforations into the control tube before the obturator can move forward to seal off the saddle of the sabot from the control-tube chamber. The front scoop of sabot optimally designed for its primary functions would distort under the pressures generated. Strengthening the front scoop would add parasitic weight to the round and porting the front scoop would result in a loss of pressure across the sabot and resultant loss in available energy for the sub-projectile at the muzzle.

SUMMARY OF THE INVENTION

An object of this invention is the provision of a cased telescoped ammunition with a perforated forward control tube in which propellant gas does not enter the control tube ahead of the obturator.

Briefly, this invention contemplates the provision of a cased telescoped ammunition with a perforated forward control tube, in which the main propellant gas and flame front ignites the propellant surrounding the tube through the control tube perforations after the obturator passes the perforations. Seals form annular segments of consolidated propellant surrounding the tube separated from each other and the main propellant charge. These seals limit the ignition path of the propellant surrounding the tube to the control tube perforations or ports which have been passed by the obturator.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
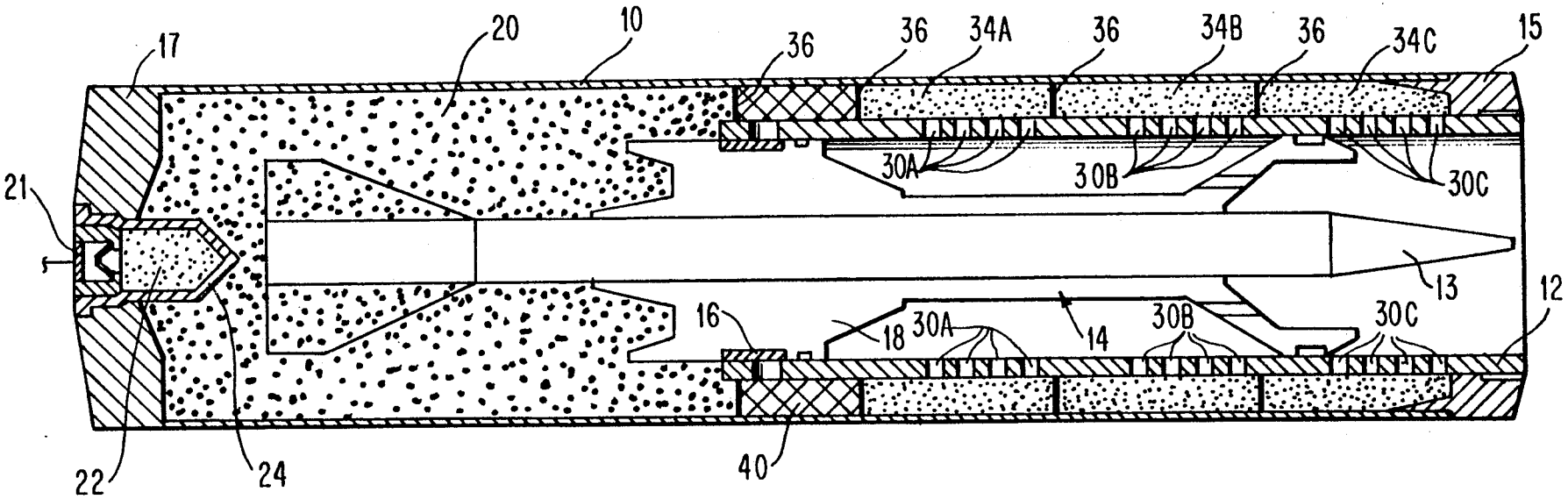
FIG. 1 is a view, partial in section, of a cased telescoped ammunition with a forward control tube in accordance with the teachings of this invention.

Referring now to FIG. 1, a cased telescoped ammunition in accordance with the teachings of this invention comprises an outer cylindrical casing 10 and coaxially disposed a forward control tube 12. The forward control tube 12 houses a sub-projectile 13 which is supported in the tube by a sabot 14. An obturator ring 16 is secured in a conventional manner to a rear portion 18 of the sabot 14. The casing 10 has a front end piece 15 and an aft end piece 17. The front end of the control tube 12 is co-terminal with the front end of the end piece 15 and the tube extends rearwardly so that its aft end is roughly a little beyond the midpoint of the casing.

A main propellant 20 (e.g., a granular propellant) fills the casing 10 aft of the sabot saddle. A primer 21 in combination with an igniter 22 in a cylindrical housing 24 secured to the aft end piece 17 ignite the main propellant 20.

Perforations or ports 30 in the tube 12 extend about its circumference and along its length. In a preferred embodiment of the invention, the ports are arranged in groups (labeled A, B, and C in the drawing). The groups of ports are separated by regions free of ports. Surrounding the control tube is a consolidated propellant 34 formed into discrete segments labeled A, B, C and by annular gas and flame front interrupter seals 36 made of a suitable material such as polyethylene. The seals prevent transmission of combustion gas and flame fronts to the propellant 34 except via ports 30.

In a preferred embodiment of the invention, an annular segment 40 surrounding the aft end of the control tube is comprised of a suitable erosion inhibitor with seals 36 on either side.

Figure 2A:
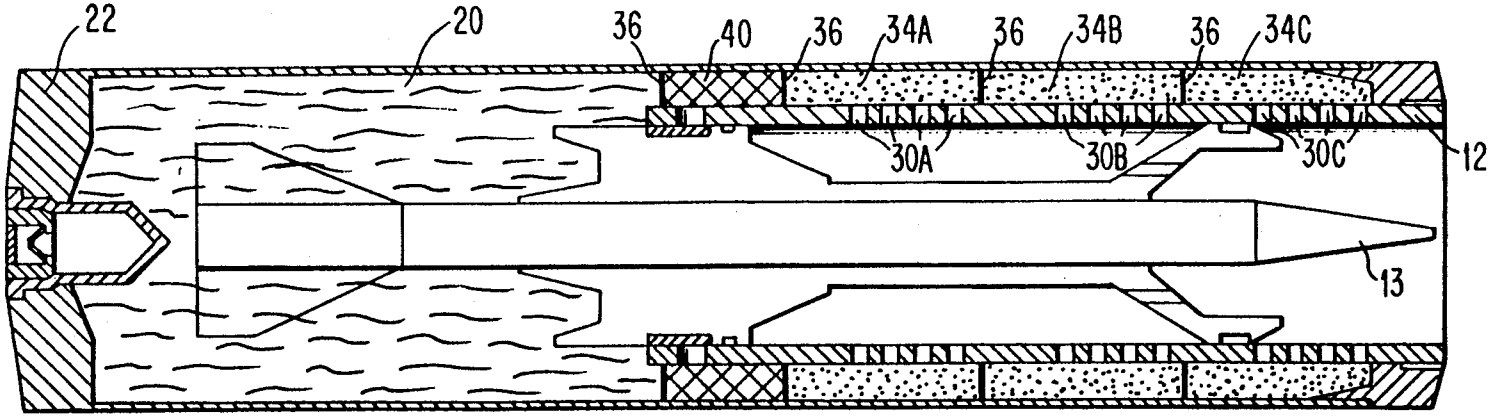
FIG. 2 is a series of views labeled FIG. 2A through FIG. 2D illustrating the sequential ignition of propellant segments along the control tube as the obturator moves through the tube.
Figure 2B:
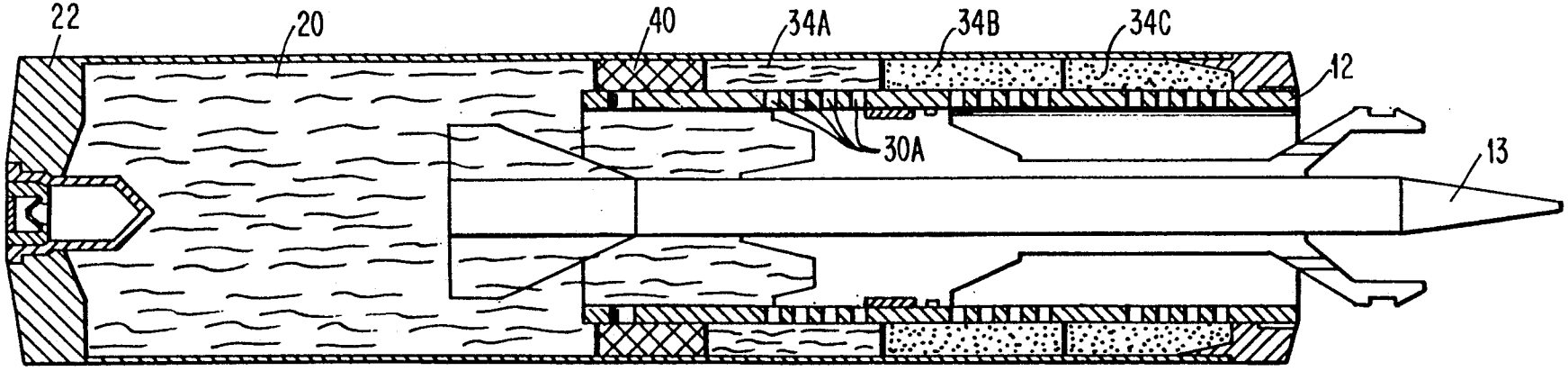
Figure 2C:
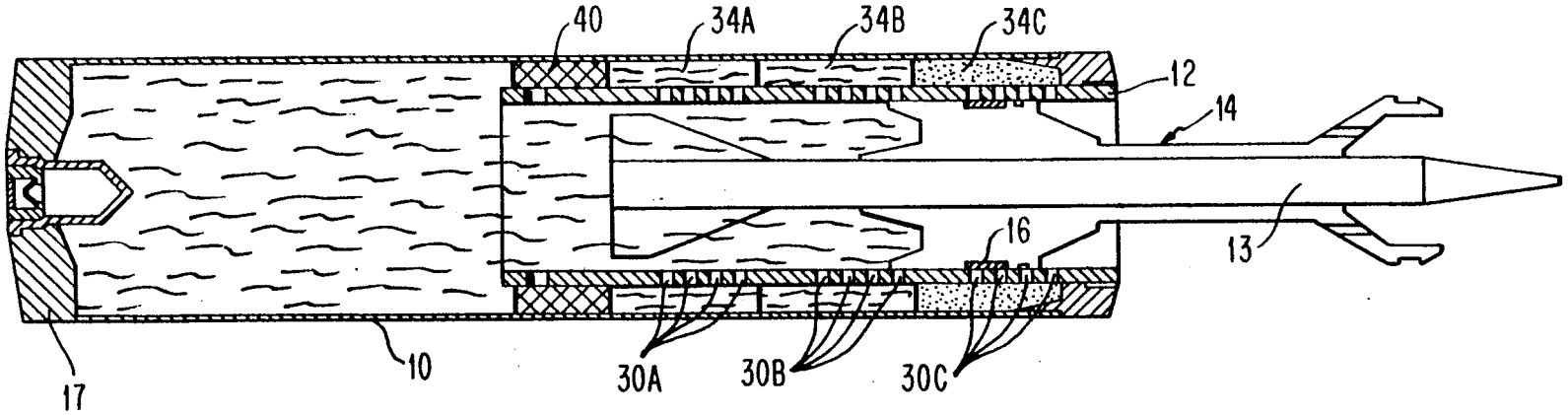
Figure 2D:
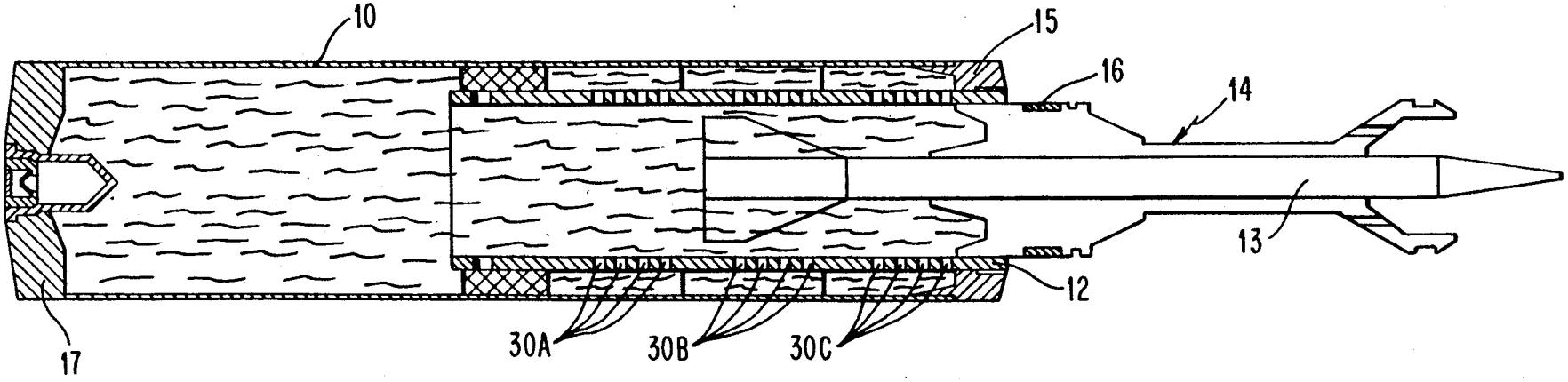

Referring now to FIG. 2 in operation initially the primer 21 ignites the igniter 22 which ignites the main propellant 20 (FIG. 2A). The pressure from ignition of this rear charge acts first against the erosion inhibitor 40 which is sandwiched between two seals 36. This load is absorbed by the stack of consolidated propellant grains 34 which transmit little or no radial pressure to the outer surface of the control tube 12. As the projectile, sabot, obturator assembly moves along the control tube (FIGS. 2B and 2C) the obturator passes groups of ports A and B in sequence. The front of the main propellant gas and flame moving down the control tube in back of the obturator ignites the propellant segments A and then B adjacent each group of ports as the obturator passes the group. As the propellant segments are sequentially ignited via the ports, the propellant gas from the ignited segment tends to equalize the pressure between the inside and outside of the control tube. The combustion product gases flow inward through the same ports used to ignite the segments. The seals 36 may be driven aft after segment ignition, providing an additional flow path for propellant gas. FIG. 2D shows the round as the sabot leaves the control tube and segment 34C is ignited.

While the specific embodiment of this invention thus far disclosed herein contemplates the use of the same propellant type in each segment A, B, and C, it should be noted that different propellant types may be used for one or more of the segments. For example, a first burning propellant at the front and slower at rear to provide greater energy with a specified peak pressure. This allows programmed ignition and control of the build-up of pressure as a result of propellant ignition.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A cased telescoped ammunition comprising in combination:

an outer cylindrical casing having an open front end;

a control tube mounted in said casing with an annular space between said casing and said tube, said control tube casing extending from a front end disposed substantially conterminous with the front end of said casing to an aft end;

a projectile, sabot, and obturator assembly mounted in said control tube along a longitudinal axis of said tube with said obturator located adjacent said aft tube end;

a first propellant in said casing aft of said aft tube end;

a second propellant in said annular space, means for separating said second propellant into a plurality of segments, said separation means preventing transmission of ignition products between adjacent segment; and a plurality of ports in said control tube disposed between said aft tube end and said front tube end, whereby each segment of said second propellant is ignited sequentially by a gas and flame front generated by ignition of said first propellant and communicated to said segments through said ports as said assembly moves through said control tube.

2. A cased telescoped ammunition as in claim 1 wherein said means for separating is an annular ring.

3. A cased telescoped ammunition as in claim 1 further including a segment filled with a corrosion inhibiter adjacent said aft tube end.

4. A cased telescoped ammunition as in claim 2 further including a segment filled with a corrosion inhibiter adjacent said aft tube end.

5. A cased telescoped ammunition as in claim 1 wherein said segments adjacent said aft tube end contain a slower burning propellant than said segments adjacent said front end.

6. A cased telescoped ammunition as in claim 2 wherein said segments adjacent said aft tube end contain a slower burning propellant than said segments adjacent said front end.

7. A cased telescoped ammunition as in claim 3 wherein said segments adjacent said aft tube end contain a slower burning propellant than said segments adjacent said front end.

8. A cased telescoped ammunition as in claim 4 wherein said segments adjacent said aft tube end contain a slower burning propellant than said segments adjacent said front end.

* * * * *

UNITED STATES PATENT AND TRADEMARK OFFICE

CERTIFICATE OF CORRECTION

PATENT NO. : 5,042,388

DATED : August 27, 1991

INVENTOR(S) : John B. Warren and David E. Broden

It is certified that error appears in the above-identified patent and that said Letters Patent is hereby corrected as shown below:

Col. 1, line 4 insert --The Government has rights in this invention pursuant to Contract No. DAAA21-86-C-0123 awarded by the Department of the Army.--

Signed and Sealed this

Fifth Day of October, 1993

*Attest:*

*Attesting Officer*

Bruce Lehman

BRUCE LEHMAN

*Commissioner of Patents and Trademarks*